US009273383B2

(12) United States Patent
Delattre et al.

(10) Patent No.: US 9,273,383 B2
(45) Date of Patent: Mar. 1, 2016

(54) LOW-ALLOY STEEL HAVING A HIGH YIELD STRENGTH AND A HIGH SULPHIDE-INDUCED STRESS CRACKING RESISTANCE

(75) Inventors: Laurent Delattre, Saint-Saulve (FR); Herve Marchebois, Valenciennes (FR); Michel Piette, Valenciennes (FR); Christoph Bosch, Dortmund (DE); Michaela Hoerstemeier, Duesseldorf (DE); Joachim Konrad, Duesseldorf (DE)

(73) Assignee: VALLOUREC OIL AND GAS FRANCE, Aulnoye-Aymeries (FR)

( * ) Notice: Subject to any disclaimer, the term of this patent is extended or adjusted under 35 U.S.C. 154(b) by 324 days.

(21) Appl. No.: 13/698,909

(22) PCT Filed: May 19, 2011

(86) PCT No.: PCT/EP2011/058134

§ 371 (c)(1),
(2), (4) Date: Nov. 19, 2012

(87) PCT Pub. No.: WO2011/151186

PCT Pub. Date: Dec. 8, 2011

(65) Prior Publication Data

US 2013/0061988 A1 Mar. 14, 2013

(30) Foreign Application Priority Data

Jun. 4, 2010 (FR) ..... 10 54418

(51) Int. Cl.

| | |
|---|---|
| ***C22C 38/22*** | (2006.01) |
| ***C22C 38/24*** | (2006.01) |
| ***C22C 38/26*** | (2006.01) |
| ***C22C 38/02*** | (2006.01) |
| ***C22C 38/04*** | (2006.01) |
| ***C22C 38/12*** | (2006.01) |

(52) U.S. Cl.

CPC ..... *C22C 38/26* (2013.01); *C22C 38/02* (2013.01); *C22C 38/04* (2013.01); *C22C 38/12* (2013.01); *C22C 38/22* (2013.01); *C22C 38/24* (2013.01)

(58) Field of Classification Search

None

See application file for complete search history.

(56) References Cited

U.S. PATENT DOCUMENTS

| | | | | |
|---|---|---|---|---|
| 5,855,845 | A | 1/1999 | Beguinot et al. | |
| 2003/0066577 | A1 | 4/2003 | Ishida et al. | |
| 2008/0017284 | A1 * | 1/2008 | Omura | 148/593 |
| 2009/0311125 | A1 | 12/2009 | Miyanishi et al. | |
| 2010/0147424 | A1 | 6/2010 | Murota et al. | |

FOREIGN PATENT DOCUMENTS

| | | | | |
|---|---|---|---|---|
| CN | 1174896 | A | 3/1998 | |
| EP | 0828007 | A1 * | 3/1998 | |
| EP | 1 862 561 | | 12/2007 | |
| EP | 2 138 597 | | 12/2009 | |
| EP | 2 154 262 | | 2/2010 | |
| FR | 2 939 449 | | 6/2010 | |
| JP | 61-064815 | | 4/1986 | |
| JP | 61064815 | A * | 4/1986 | C22C 38/38 |
| JP | 61 272351 | | 12/1986 | |
| JP | 2011246798 | | 12/2011 | |
| JP | 2012511630 | | 5/2012 | |

OTHER PUBLICATIONS

International Search Report Issued Jul. 5, 2011 in PCT/EP11/58134 Filed May 19, 2011.

* cited by examiner

*Primary Examiner* — Deborah Yee

(74) *Attorney, Agent, or Firm* — Oblon, McClelland, Maier & Neustadt, L.L.P.

(57) ABSTRACT

A steel contains, by weight: C: 0.3% to 0.5%, Si: 0.1% to 0.5%, Mn: 1% or less, P: 0.03% or less, S: 0.005% or less, Cr: 0.3% to 1%, Mo: 1% to 2%, W: 0.3% to 1%, V: 0.03% to 0.25%, Nb: 0.01% to 0.15%, Al: 0.01% to 0.1%, the remainder of the chemical composition of the steel being constituted by Fe and impurities or residuals resulting from or necessary to steel production and casting processes. The steel can be used to produce seamless tubes for hydrocarbon wells with a yield strength after heat treatment of 862 MPa or more or even 965 MPa or more.

13 Claims, No Drawings

LOW-ALLOY STEEL HAVING A HIGH YIELD STRENGTH AND A HIGH SULPHIDE-INDUCED STRESS CRACKING RESISTANCE

The invention relates to low alloy steels with a high yield strength which have excellent sulphide stress cracking behaviour. In particular, the invention is of application to tubular products for hydrocarbon wells containing hydrogen sulphide ($H_2S$).

Exploring and developing ever deeper hydrocarbon wells which are subjected to ever higher pressures at ever higher temperatures and in ever more corrosive media, in particular when loaded with hydrogen sulphide, means that the need to use low alloy tubes with both a high yield strength and high sulphide stress cracking resistance is ever increasing.

The presence of hydrogen sulphide, $H_2S$, is responsible for a dangerous form of cracking in low alloy steels with a high yield strength which is known as SSC (sulphide stress cracking) which may affect both casing and tubing, risers or drill pipes and associated products. Hydrogen sulphide is also a gas which is fatal to man in doses of a few tens of parts per million (ppm), and it is imperative that it does not escape if tubes crack or break. SSC resistance is thus of particular importance for oil companies since it is of importance to the safety of both equipment and personnel.

The last decades have seen the successive development of low alloy steels which are highly resistant to $H_2S$ with minimum specified yield strengths which are getting higher and higher: 551 MPa (80 ksi), 620 MPa (90 ksi), 655 MPa (95 ksi) and more recently 758 MPa (110 ksi) or even 862 MPa (125 ksi).

Today's hydrocarbon wells frequently reach down to depths of several thousand meters and the weight of strings satisfying standard yield strengths is thus very high. Further, pressures in the hydrocarbon reservoirs may be very high, of the order of several hundred bar, and the presence of $H_2S$, even at relatively low levels of the order of 10 to 100 ppm, results in partial pressures of the order of 0.001 to 0.1 bar, which is sufficient when the pH is low to cause SSC phenomena if the material of the tubes is not suitable. In addition, the use of low alloy steels combining a minimum specified yield strength of 862 MPa (125 ksi) or preferably 965 MPa (140 ksi) with good SSC resistance would be particularly welcome in such strings.

For this reason, we sought to obtain a low alloy steel with both a minimum specified yield strength of 862 MPa (125 ksi), preferably 965 MPa (140 ksi) and good SSC behaviour, which is difficult since, as is well known, the SSC resistance of low alloy steels reduces as their yield strength increases.

Patent application EP-1 862 561 proposes a low alloy steel with a high yield strength (862 MPa or more) and excellent SSC resistance, disclosing a chemical composition which is advantageously associated with an isothermal bainitic transformation heat treatment in the temperature range 400-600° C.

In order to obtain a low alloy steel with a high yield strength, it is well known to carry out a quenching and tempering heat treatment at a relatively low temperature (less than 700° C.) on a Cr—Mo alloy steel. However, according to patent application EP-1 862 561, a low temperature temper contributes to a high dislocation density and the precipitation of coarse $M_{23}C_6$ carbides at the grain boundaries, resulting in poor SSC behaviour. Patent application EP-1 892 561 thus proposes to improve the SSC resistance by increasing the tempering temperature in order to reduce the dislocation density and to limit the precipitation of coarse carbides at the grain boundaries by limiting the joint (Cr+Mo) content to a value in the range 1.5% to 3%. However, since there is then a risk that the yield strength of the steel will fall because of the high tempering temperature, patent application EP-1 862 561 proposes increasing the C content (between 0.3% and 0.6%) associated with sufficient addition of Mo and V (respectively 0.5% or more and in the range 0.05% to 0.3%) to precipitate fine MC carbides.

However, there is then a risk that such an increase in the C content will cause quenching cracks with the conventional heat treatments (water quench+temper) which are applied, and so patent application EP-1 862 561 proposes an isothermal bainitic transformation heat treatment in the temperature range 400-600° C. which can prevent cracking during water quenching of steels with high carbon contents and also mixed martensite-bainite structures which are considered to be deleterious to the SSC in the case of a milder quench, for example an oil quench.

The bainitic structure obtained (equivalent, according to EP-1 862 561, to the martensitic structure obtained by conventional quench+temper heat treatments) then has a high yield strength (862 MPa or 125 ksi or more) associated with excellent SSC behaviour tested using NACE standard TM0177, methods A and D (National Association of Corrosion Engineers).

However, the industrial use of such an isothermal bainitic transformation requires very tight control of the treatment kinetics so that other transformations (martensitic or perlitic) are not triggered. Further, depending on the thickness of the tube, the quantity of water used for the quench varies, which means that the tube cooling rates have to be monitored in order to obtain a monophase bainitic structure.

The aim of the present invention is to produce a low alloy steel composition:

- which can be heat treated to produce a yield strength of 862 MPa (125 ksi) or more and preferably 965 MPa (140 ksi) or more;
- with a SSC resistance, tested using NACE standard TM0177, method A, but with partial pressures of $H_2S$ of 0.03 bars, which is excellent especially at the yield strengths indicated above;
- and which does not require the industrial installation of a bainitic quench, meaning that the production costs for seamless tubes are lower than those associated with document EP-1 862 561.

In accordance with the invention, the steel contains, by weight:

C: 0.3% to 0.5%
Si: 0.1% to 1%
Mn: 1% or less
P: 0.03% or less
S: 0.005% or less
Cr: 0.3% to 1%
Mo: 1% to 2%
W: 0.3% to 1%
V: 0.03% to 0.25%
Nb: 0.01% to 0.15%
Al: 0.01% to 0.1%

The remainder of the chemical composition of this steel is constituted by iron and impurities or residuals resulting from or necessary to steel production and casting processes.

The influence of the elements of the chemical composition on the properties of the steel is as follows:

Carbon: 0.3% to 0.5%

The presence of this element is vital to improving the quenchability of the steel and means that the desired high specification mechanical characteristics can be obtained. The inventors have also shown that relatively high carbon contents procure a better SSC resistance, although the reason for such behaviour is neither identified nor known. A content of less than 0.3% could only produce the desired yield strength (140 ksi or more) for relatively low tempering temperatures, which does not contribute to guaranteeing sufficient SSC resistance. On the other hand, if the carbon content exceeds 0.5%, then on the one hand the heat treatment, especially a martensitic quench in a medium less severe than water, becomes difficult to manage on great length tubes (10 to 15 meters) and on the other hand, the quantity of carbides formed during tempering becomes excessive and may result in a deterioration in the SSC resistance.

If only a water quench unit is available, it would be preferable to select a carbon content towards the bottom of the range indicated above in order to avoid quench cracking: as an example, a carbon content in the range 0.32% to 0.38% would be selected.

If a unit for quenching using a quenching fluid were available with a quench severity characteristic that was lower than that of water (for example an oil quench or a quench with water supplemented with polymers), it would be advantageous to select a carbon content towards the top of the range indicated above: as an example, a carbon content in the range 0.38% to 0.46%, preferably a carbon content in the range 0.40% to 0.45%, would be selected.

Silicon: 0.1% to 1%

Silicon is an element which deoxidizes liquid steel. A content of at least 0.1% can produce such an effect. Silicon also counters softening on tempering and for this reason contributes to improving SSC resistance. Beyond 0.5%, it is often written that this element results in a deterioration of SSC resistance. However, the inventors have shown that the Si content could reach 1% without having an unfavourable effect on SSC resistance. For this reason, its content is fixed to between 0.1% and 1%. A range of 0.5% to 1% has also been shown to be advantageous in combination with the other elements of the composition of the invention.

Manganese: 1% or Less

Manganese is an element which improves the forgeability of steel and contributes to its quenchability. Beyond 1%, however, it gives rise to segregations which are deleterious to SSC resistance. For this reason, its maximum content is fixed at 1% and preferably at 0.5%. In order to avoid problems with forgeability (burning), its minimum content is preferably fixed at 0.2%.

Phosphorus: 0.03% or Less (Impurity)

Phosphorus is an element which degrades SSC resistance by means of its segregation at the grain boundaries. For this reason, its content is limited to 0.03%.

Sulphur: 0.005% or Less (Impurity)

Sulphur is an element which forms inclusions which are deleterious to SSC resistance and which can also segregate at the grain boundaries. The effect becomes substantial beyond 0.005%. For this reason, its content is limited to 0.005% and preferably to an extremely low level, such as 0.003%.

Chromium: 0.3% to 1%

Chromium is an element which is useful in improving the quenchability and mechanical characteristics of steel and increasing its SSC resistance. For this reason, its minimum content is fixed at least 0.3%. However, a content of 1% should not be exceeded in order to prevent deterioration of the SSC resistance.

For this reason, its content is fixed to between 0.3% and 1%. The preferred lower and upper limits are respectively 0.3% and 0.8%, highly preferably 0.4% and 0.6%.

Molybdenum: 1% to 2%

Molybdenum is a useful element for improving the quenchability of steel and can also increase the tempering temperature of the steel. The inventors have observed a particularly favourable effect for Mo contents of 1% or more. In contrast, if the molybdenum content exceeds 2%, it tends to favour the formation of coarse compounds after rapid tempering, to the detriment of SSC resistance. For this reason, its content is fixed to between 1% and 2%. The preferred range is between 1.2% and 1.8%, highly preferably between 13% and 1.7%.

Tungsten: 0.3% to 1%

Like molybdenum, tungsten is an element which improves the quenchability and strength of steel. It is an element which is important to the invention as not only can it be used to tolerate a large Mo content without entraining the precipitation of coarse $M_{23}C_6$ carbides and ksi carbides during rapid tempering but, in contrast, it can encourage fine and homogeneous precipitation of micro-carbides, MC, limiting their enlargement because of its low diffusion coefficient. Tungsten thus effectively increases the molybdenum content in order to raise the tempering temperature and thus to reduce the dislocation density and improve SSC resistance. A content of at least 0.3% is used for this purpose. Beyond 1%, its effect no longer changes. For this reason, the Mo content is fixed at between 0.3% and 1%. The preferred lower and upper limits are respectively equal to 0.4% and 0.7%.

Vanadium: 0.03% to 0.25%

Like molybdenum, vanadium is an element which improves the SSC resistance by forming very fine micro-carbides, MC, which can raise the tempering temperature of the steel. It must be present in an amount of at least 0.03% in order to exert its effect. However, too much precipitation of these carbides tends to embrittle the steel. For this reason, its content is limited to 0.25%. The inventors have observed a joint influence of the elements Nb and V. When the Nb content is relatively low (0.01% to 0.03%), the preferred range for the V content is in the range 0.1% to 0.25%, more preferably in the range 0.1% to 0.2%.

Niobium: 0.01% to 0.15%

Niobium is an addition element which forms carbonitrides with carbon and nitrogen. Their anchoring effect makes an effective contribution to refining the grain during austenitization. At the usual austenitization temperatures, the carbonitrides are partially dissolved and the niobium has a hardening effect (or it retards softening), by precipitation of carbonitrides on tempering, which is smaller than that of vanadium. In contrast, undissolved carbonitrides effectively anchor austenitic grain boundaries during austenitization, thus allowing a very fine austenitic grain to be produced prior to quenching, which has a highly favourable effect on the yield strength and on the SSC resistance. The inventors also believe that this austenitic grain refining effect is enhanced by a double tempering operation. For the refining effect of niobium to be expressed, this element must be present in an amount of at least 0.01%. However, beyond 0.15%, Nb carbonitrides are too abundant and relatively coarse, which is not favourable to SSC resistance. When the V content is relatively high (0.1% to 0.25%), the preferred range for the Nb content is in the range 0.01% to 0.03%.

Vanadium+2×Niobium: Optionally in the Range 0.10% to 0.35%

The inventors have observed a joint influence of the elements V and Nb on tempering retardation and thus on SSC resistance. More niobium may be added when the V content is relatively low (about 0.04%) and vice versa (seesaw or teeter-totter effect between these elements). In order to express this joint influence of the elements Nb and V, the inventors have optionally introduced a limitation to the sum V+2×Nb which may be in the range 0.10% to 0.35%, preferably in the range 0.12% to 0.30%.

Aluminium: 0.01% to 0.1%

Aluminium is a powerful steel deoxidant and its presence also encourages the desulphurization of steel. It is added in an amount of at least 0.01% in order to have this effect. However, beyond 0.1%, steel deoxidation and desulphurization is no longer substantially improved, and coarse, harmful Al nitrides also tend to be formed. For this reason, the upper limit for the Al content is fixed at 0.1%. The preferred lower and upper limits are respectively 0.01% and 0.05%.

Titanium: Impurity

A Ti content of more than 0.01% favours the precipitation of titanium nitrides, TiN, in the liquid phase of the steel and may result in the formation of coarse TiN precipitates which are deleterious to the SSC resistance. Ti contents of 0.01% or less may result from impurities originating from the production of liquid steel and not resulting from deliberate addition. According to the inventors, such small quantities do not, however, have a deleterious effect on SSC resistance for low nitrogen contents (0.01% or less). Preferably, the maximum quantity of Ti impurity is limited to 0.005%.

Nitrogen: Impurity

A nitrogen content of more than 0.01% is susceptible of reducing the SSC resistance of steel. Thus, it is preferably kept to a quantity of less than 0.01%.

Boron: Impurity

This nitrogen-greedy element enormously improves quenchability when it is dissolved in steel.

In order to obtain this effect, it is necessary to add boron in amounts of at least 10 ppm ($10^{-4}$%).

Micro-alloy boron steels generally contain titanium in order to fix the nitrogen and form TiN compounds, thereby leaving the boron available.

In the case of the present invention, the inventors have found that for steels with a very high yield strength which must be resistant to SSC, adding boron was not necessary for the steel of the invention or could even be deleterious. Thus, boron takes the form of an impurity in the steel of the invention

EXAMPLE OF AN EMBODIMENT

Two 100 kg laboratory castings, with references A and B, of a steel of the invention were produced then worked by hot rolling into flats with a width of 160 mm and a thickness of 12 mm.

For comparison, a laboratory casting with reference C, outside the composition ranges of the present invention, was also produced and transformed into flats similar to those of castings A and B.

Table 1 shows the chemical composition of the product (rolled flat) of the three test castings (all of the percentages given are by weight).

TABLE 1

| Ref | C | Si | Mn | P | S | Cr | Mo | W | V |
|---|---|---|---|---|---|---|---|---|---|
| A | 0.43 | 0.79 | 0 | 0.010 | 0.003 | 0.50 | 1.46 | 0.64 | 0.20 |
| B | 0.34 | 0.36 | 0.39 | 0.011 | 0.003 | 0.49 | 1.29 | 0.52 | 0.10 |
| C* | 0.33 | 0.37 | 0.38 | 0.011 | 0.003 | 0.98 | 1.50 | 0.008* | 0.05 |

| Ref | Nb | V + 2Nb | Al | N | Ti | B |
|---|---|---|---|---|---|---|
| A | 0.019 | 0.24 | 0.03 | 0.0045 | 0.002 | 0.0005 |
| B | 0.021 | 0.14 | 0.02 | 0.0023 | 0.002 | 0.0005 |
| C* | 0.081 | 0.21 | 0.02 | 0.0031 | 0.009 | 0.0012* |

*comparative example

Castings A and B had a high V content and a low Nb content and for casting C, the balance of these elements was the opposite.

Casting B was a variation of casting A with a lower C and Si content.

Casting C contained no W but contained additional Ti and boron.

Casting A underwent dilatometric tests in order to determine the heating transformation points Ac1 and Ac3, the temperatures Ms and Mf of martensitic transformation and the critical martensitic quench rate.

Act=765° C. Ac3=880° C. Ms=330° C. Mf=200° C.

The Act point was high and means that high temperature tempering can be carried out.

The structure obtained with a cooling rate of 20° C./s was entirely martensitic; for a cooling rate of 7° C./s, the bainite content was 15%. The critical martensitic quench rate was thus close to 10° C./s.

Table 2 indicates the values for the yield strength Rp0.2 and mechanical strength at rupture Rm obtained for flats of the various castings after double quench and temper heat treatment.

Two quench operations were carried out at temperatures close to 950° C. in order to attempt to better refine the size of the austenitic grains and a temper between the two quench operations was carried out in order to prevent the generation of quench cracks between these operations.

The final temper was carried out between 680° C. and 730° C. using references A to C in order to obtain a value for the yield strength of 965 MPa (140 ksi) or more.

TABLE 2

| Ref | Product/ thickness (mm) | Heat treatment (**) | Yield strength MPa (ksi) | Break strength MPa (ksi) | Rp0.2/Rm |
|---|---|---|---|---|---|
| A | Rolled flat/12 mm | WQ + T + WQ + T | 1005 (146) | 1051 (152) | 0.96 |
| B | Rolled flat/12 mm | WQ + T + WQ + T | 1010 (147) | 1078 (156) | 0.94 |
| C | Rolled flat/12 mm | WQ + T + WQ + T | 995 (144) | 1066 (155) | 0.93 |

* comparative example (**) WQ = water quench; T = temper

The values for the mechanical strength Rm were very close to those of the yield strength (Rp0.2/Rm ratio close to 0.95), which is favourable to SSC resistance. It is highly probable that Rm is 1150 MPa or less and preferably 1120 or less or even 1100 MPa or less in order to encourage SSC resistance.

The size of the austenitic grains prior to the second quench operation was measured; Table 3 shows the results obtained.

TABLE 3

| Ref | Size of austenitic grains according to ASTM E112 |
|---|---|
| A | 11 |
| B | 13 |
| C* | 13 |

*Comparative example

In all cases the grains were very fine and this grain size probably resulted from the beneficial effects of a double quench.

Table 4 shows the mean values of three Rockwell C(HRc) hardness impressions carried out on the specimens treated in accordance with Table 2 at three different locations: close to each of the surfaces and at mid-thickness of the flats.

TABLE 4

| | Hardness, HRc | | |
|---|---|---|---|
| Reference | Surface 1 | Mid-thickness | Surface 2 |
| A | 34.2 | 34.5 | 34.5 |
| B | 33.9 | 34.9 | 34.1 |
| C* | 33.6 | 33.3 | 34.0 |

*comparative example

Note only a small variation in the hardness through the thickness of the flats (at most 1 HRc), indicating a martensitic quench throughout the thickness of the flats.

The maximum values in the table are close to of the order of 35 HRc and a maximum value of 36 HRc may appear desirable in order to favour SSC.

Table 5 shows the mean values for the results of low temperature (−20° C. to −40° C.) Charpy V resilience tests on specimens taken in the longitudinal direction of flats from casting A treated in accordance with Table 2.

TABLE 5

| Reference | KV (J) at −40° C. | KV (J) at −20° C. |
|---|---|---|
| A | 30 | 39 |

The values obtained were all over 27 J (energy value corresponding to the criterion in specification API 5CT) at −40° C.

Table 6 shows the results of tests to determine the SSC resistance using method A of specification NACE TM0177.

The test specimens were cylindrical tensile specimens taken longitudinally at the mid-thickness from flats treated in accordance with Table 2 and machined in accordance with method A of specification NACE TM0177.

The test bath used was of the EFC 16 type (European Federation of Corrosion). The aqueous solution was composed of 5% sodium chloride (NaCl) and 0.4% sodium acetate ($CH_3COONa$) with a 3% $H_2S$/97% $CO_2$ gas mixture bubbled through continuously at 24° C. (±3° C.) and adjusted to a pH of 3.5 using hydrochloric acid (HCl).

The load was fixed at 85% of the specified minimum yield strength (SMYS), i.e. 85% of 965 MPa, namely 820 MPa. Three specimens were tested under the same test conditions to take into account the relative dispersion of this type of test.

The SSC resistance was adjudged to be good (symbol O) in the absence of breakage of at least two specimens after 720 h and poor (symbol X) if breakage occurred before 720 h in the calibrated portion of at least two specimens out of the three test pieces. The tests on reference A were carried out in duplicate.

TABLE 6

| | | NACE test method A | | | | |
|---|---|---|---|---|---|---|
| | Rp | | | Applied load | | |
| | 0.2 | Environment | | | Value in | Result |
| Ref | (MPa) | pH | $H_2S$ (%) | Load | MPa (ksi) | >720 h |
| A** | 1005 | 3.5 | 3 | 85% SMYS | 820 (119) | O<br>O |
| B | 1010 | 3.5 | 3 | 85% SMYS | 820 (119) | X |
| C* | 995 | 3.5 | 3 | 85% SMYS | 820 (119) | X |

*comparative example;
**duplicated tests

The results obtained for references A and B of the steel in accordance with the invention treated at 1005 and 1010 MPa passed the tests, in contrast to those on reference C, of a comparative steel, treated at 995 MPa.

The steel of the invention is of particular application to products intended for exploration and production of hydrocarbon wells such as in casing, tubing, risers, drill pipes, heavy weight drill pipes, drill collars or accessories for the above products.

The invention claimed is:

1. A light alloy steel, comprising, by weight:
C: 0.3% to 0.5%;
Si: 0.1% to 1%;
Mn: 1% or less;
P: 0.03% or less;
S: 0.005% or less;
Cr: 0.3% to 1%;
Mo: 1.29% to 2%;
W: 0.52% to 1%;
V: 0.03% to 0.25%;
Nb: 0.01% to 0.15%;
Al: 0.01% to 0.1%; and
Fe;
wherein
a microstructure of the light alloy steel consists of a martensitic structure, and
Ti is not deliberately added and is an impurity obtained from the steel production such that the content of Ti is less than 0.005%.

2. The steel according to claim 1, wherein the C content is from 0.32% to 0.38%.

3. The steel according to claim 1, wherein the C content is from 0.40% to 0.45%.

4. The steel according to claim 1, wherein the Mn content is from 0.2% to 0.5%.

5. The steel according to claim 1, wherein the Cr content is from 0.3% to 0.8%.

6. The steel according to claim 1, wherein the V content is from 0.1% to 0.25%; and the Nb content is from 0.01% to 0.03%.

7. The steel according to claim 1, wherein a V+2×Nb content is in the range 0.10% to 0.35%.

8. The steel according to claim 1, wherein N is not deliberately added and is an impurity obtained from the steel production such that the content of N is 0.01% or less.

9. The steel according to claim 1, wherein the steel is quench and temper heat treated so that its yield strength is 862 MPa (125 ksi) or more.

10. The steel according to claim 1, wherein the steel is quench and temper heat treated so that its yield strength is 965 MPa (140 ksi) or more.

11. The steel according to claim 9, wherein the temper heat treatment comprises two quench operations.

12. The steel according to claim 1, wherein a yield strength is 862 MPa or higher and when tested in an European Federation of Corrosion (EFC) type 16 bath for sulfide stress cracking characteristics, specimens not breaking after 720 hours are obtained.

13. The steel according to claim 10, wherein the temper heat treatment comprises two quench operations.

* * * * *

UNITED STATES PATENT AND TRADEMARK OFFICE

CERTIFICATE OF CORRECTION

PATENT NO. : 9,273,383 B2
APPLICATION NO. : 13/698909
DATED : March 1, 2016
INVENTOR(S) : Laurent Delattre et al.

It is certified that error appears in the above-identified patent and that said Letters Patent is hereby corrected as shown below:

In the Specification

Column 4, line 10, "13%" should read --1.3%--

Column 6, line 27, "Act=765°C." should read --Ac1=765°C.--

Column 6, line 28, "Act point" should read --Ac1 point--

Signed and Sealed this
Nineteenth Day of July, 2016

Michelle K. Lee

Michelle K. Lee
*Director of the United States Patent and Trademark Office*